United States Patent [19]

Duplin

[11] 4,351,528

[45] Sep. 28, 1982

[54] SPORTS STICK HANDLE

[75] Inventor: Joseph R. Duplin, Winthrop, Mass.

[73] Assignee: William H. Brine, Jr., Weston, Mass.

[21] Appl. No.: 166,498

[22] Filed: Jul. 7, 1980

[51] Int. Cl.[3] ..... A63B 59/14

[52] U.S. Cl. ..... 273/67 A

[58] Field of Search ..... 273/67 R, 67 A, 67 DA, 273/72 R, 72 A, 73 J, 75, 76, 81 R, 81 B, 81.3, 81.4, 84

[56] References Cited

U.S. PATENT DOCUMENTS

| | | | |
|---|---|---|---|
| D. 178,866 | 10/1956 | Cole | 273/72 R X |
| 1,637,650 | 8/1927 | McMurray | 273/84 R X |
| 2,775,455 | 12/1956 | Liberti | 273/72 R |
| 2,895,737 | 7/1959 | Blees | 273/72 R X |
| 2,957,208 | 10/1960 | Gardner et al. | 273/67 A X |
| 3,554,545 | 1/1971 | Mann | 273/72 R |

OTHER PUBLICATIONS

"Voit" Catalog; Jul. 1953; p. 22.

*Primary Examiner*—Anton O. Oechsle

*Attorney, Agent, or Firm*—Wolf, Greenfield & Sacks

[57] ABSTRACT

Sports stick handles have a notched recess within the cross-sectional outline of elongated axially extending shanks, at an end thereof, to permit gripping of the shank end by the hand of the user, with the axis of the shank substantially coaxial with the axis of the forearm and with the hand in a relaxed gripping position. Hockey sticks and lacrosse sticks so formed provide for ease and comfort in use with maximized playing ability.

2 Claims, 5 Drawing Figures

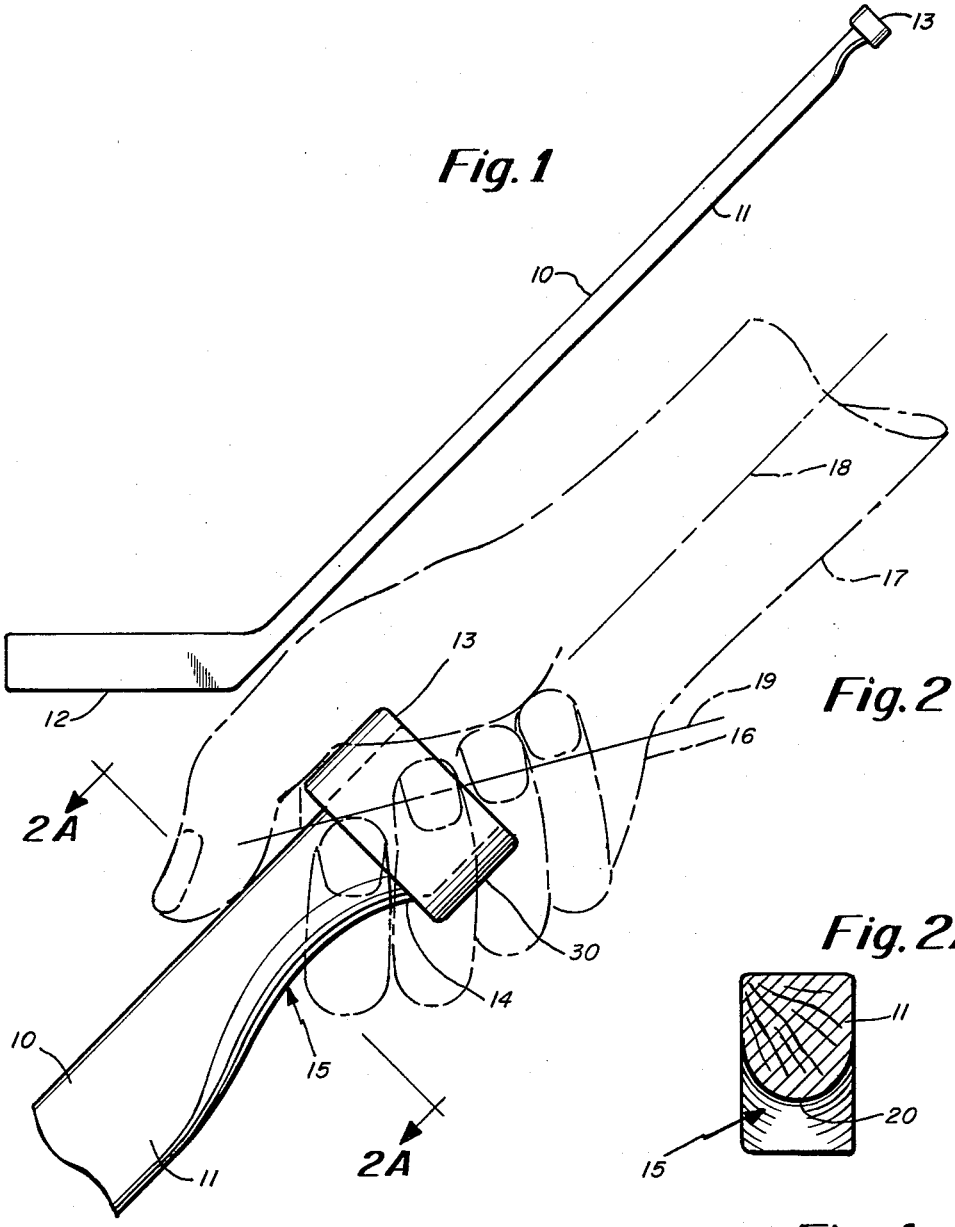
Fig. 1
Fig. 2
Fig. 2A
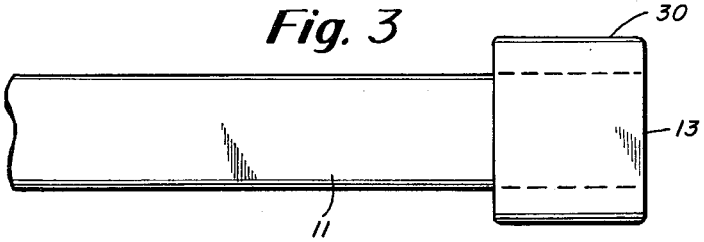
Fig. 3
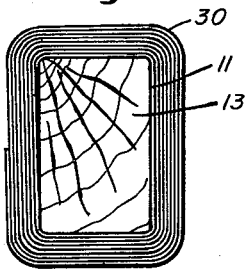
Fig. 4

SPORTS STICK HANDLE

BACKGROUND OF THE INVENTION

Sports stick handles have been modified by others in the past in various ways to enhance ease of use and provide for maximized power with reduced fatigue and tension. Most often such modifications to handles involved radical redesigns as in U.S. Pat. No. 4,038,719 where handle ends are offset from the main axis of handle shanks and have tapering portions. Such complicated design, leads to uncommon appearing handles which are sometimes difficult to form particularly when the handles are formed of wood. Similarly, U.S. Pat. No. 4,183,528 defines a natural physiological grip for game rackets having particular offset features which can be difficult to form and manufacture. U.S. Pat. No. 4,147,348 is yet another example of a racket design which provides for gripping of a racket other than along a straight shank axis, but, is highly specialized involving extraordinary forming techniques.

SUMMARY OF THE INVENTION

It is an object of this invention to provide a sports stick handle particularly useful in hockey sticks and lacrosse sticks which has a notch recess to enable ease and comfort in use as well as ease of manufacture in a simple and efficient manner.

Still another object of this invention is to provide a sports stick handle in accordance with the preceding object which permits a hockey player to lower a hockey stick handle close to the ground by an arm movement without substantial knee bending.

Still another object of this invention is to provide for relaxed gripping of a sports stick handle while keeping the axis of the shank of the handle and the forearm axis substantially aligned to provide for efficient play with the hand in a relaxed position.

According to the invention a sports stick handle particularly useful as a hockey stick handle and lacrosse stick handle has an elongated axially extending main shank portion defining a hand gripping end. The shank portion defines a cross-sectional outline and an end retaining stop formed by a notch recess within the cross sectional outline of the shank. The notch recess permits gripping of the shank end by the hand of the use with the axis of the shank substantially coaxial with the axis of the forearm and the hand in a relaxed gripping position with the grip line of the hand at an angle to the shank.

The notch recess is spaced from an end wall defined by the handle by a distance less than the hand span of a user. The notch recess is preferably merely a curved cutaway section of the shank cross section. This enables the top line of the handle to remain in a substantially uncut, straight form and minimizes the treatment of the handle from the ordinary manufacturing treatment. Thus in wood handles, bending, shaping and the like is avoided. A simple cutout is provided.

It is a feature of this invention that the notch recess is inexpensive and easy to form in conventional hockey and lacrosse handles particularly wood handles. The notch recess can also be formed in plastic handles and shanks. The notch recess gives the player a physical stop so he knows when his hand reaches the end of the handle in play. It allows the player to put the stick lower to the ground in hockey without having to bend the knees since the hand can extend into the notch.

Hockey sticks and lacrosse sticks can be used with one hand, easier than without the notch, because of the ease of gripping. The stick shank remains the same as in a conventional handle, with only a cutaway portion necessary, thereby avoiding difficult shaping and designing steps.

DESCRIPTION OF THE DRAWINGS

The above and other features, objects and advantages of the present invention will be better understood from a reading of the following specification in connection with the accompanying drawings in which:

FIG. 1 is a side view through a preferred embodiment of this invention;

FIG. 2 is a fragmentary portion of a preferred embodiment of a handle of the hockey stick shown in FIG. 1;

FIG. 2*a* is a cross section through line 2*a*,

FIG. 3 is a top plan view thereof; and

FIG. 4 is a rear view thereof.

DESCRIPTION OF PREFERRED EMBODIMENTS

With reference now to the drawing and more particularly FIGS. 1 and 2 a hockey stick is shown at 10 havng an elongated axially extending main shank 11 with a stick end or blade 12 at one end and another end portion having an end wall 13. The shank portion defines a cross-sectional outline along its axis corresponding to the rectangular end shown in the end view of FIG. 4 by end wall 13. A stop edge 14 is provided by a notch 15 with the stop edge 14 being spaced from the end wall 13 by a distance less than the grip of a user's hand 16 of the forearm 17. The shank 11 has an elongated central axis which is substantially coaxial with the axis 18 of the forearm in use while the hand has a gripping axis 19 through the hand at an angle to the axis 18. While the axis of the forearm and shank need not be coaxial, they are substantially parallel in the most comfortable position of the hand in use. This position prevents fatigue, yet, allows maximized force and manipulation of a hockey stick or lacrosse stick handle used with the invention. The grip axis of the hand or fist at line 19 is preferably at an acute angle with the forearm axis. This angle is the rest angle of the hand when holding the stick with the forearm substantially coaxial with the stick shank.

The notch recess 15 when in a wood handle can be machined easily. It preferably has a rounded cross section as best seen in FIG. 2*a* at 20 to enhance ease and comfort in use. The notch recess is spaced from the end wall 13 a distance less than the hand span of the user and preferably 1 to 3 inches at most. In wood handles mere machining does the job easily. In plastic or other handles, where machining is not desired for any reason, the recess can be molded directly into the handle. The exact contour of the notch can vary greatly as long as the stop edge 14 is provided to prevent the stick from being easily removed and slipping out the hand of a user in use and ordinary play.

In the specific example shown, the hockey stick cross section is a rectangle with slightly beveled edges having a height of about $1\frac{1}{4}$ inch and a width of about $\frac{3}{4}$ inch. The depth of the notch at its deepest point is about $\frac{1}{2}$ inch gradually tapering over the 3-inch length of the notch recess. The space between the end of the notch and the end wall is about 1 inch. To further enhance the stop action to prevent sliding of the stick from the hand of the user, conventional adhesive or sports stick wrapping tape 30 is built up over the end portion of the shank to give further stop action to the hand and further enhance ease of use of the stick. The bulbular end aids in the stop action of the notch recess.

The notch 15 is preferably arcuate in side view as shown in FIG. 1. This permits the hand grip as shown in the drawing. In addition, when it is desired to lower the stick, the forearm 17 can be brought to a position where its axis is perpendicular to the axis 19 as shown. The stick end is then lowered, yet the hand position is still comfortable and a positive stop edge 14 remains to prevent sliding of the stick from the grip of the user.

It is a feature of this invention that since the notch can easily be formed, it can be formed in existing sticks as well as newly manufactured sticks. The hockey stick handle notch recess can also be used for lacrosse merely by replacing the blade end with a lacrosse net. The specific cross section of the sticks can vary from rectangular, square, polygon and others.

The length and other dimensions given can also vary. In all cases the notch recess gives ease of handling in an easily and inexpensively formed feature of otherwise conventional hockey sticks and lacrosse sticks.

What is claimed is:

1. A hockey stick comprising an enlarged axially extending main shank having a straight axis and defining a hand gripping end and another end having an angled blade extending therefrom, said shank defining a polygonal cross-sectional outline at the gripping and an end retaining stop formed by a hand receiving notch recess within said cross-sectional outline disposed on the side of said axis opposite to that of said blade thereby permitting gripping of said shank end by the hand of a user with the axis of the shank substantially coaxial with the axis of the forearm and the hand in a relaxed gripping position with the gripping axis of the hand at an angle to the shank, said notch recess being spaced from an end wall defined by said handle by a distance less than the hand span of a user, said notch recess being a curved cutaway of said shank cross section.

2. A hockey stick in accordance with claim 1 and further comprising said shank end being wrapped with a bulbular tape wrapping.

* * * * *